United States Patent [19]

Nagashima

[11] Patent Number: 4,835,866

[45] Date of Patent: Jun. 6, 1989

[54] DEVICE FOR MOUNTING CARBURETOR ON INTERNAL COMBUSTION ENGINE

[75] Inventor: Akira Nagashima, Kawasaki, Japan

[73] Assignee: Kioritz Corporation, Tokyo, Japan

[21] Appl. No.: 131,834

[22] Filed: Dec. 11, 1987

[30] Foreign Application Priority Data

Dec. 17, 1986 [JP] Japan ..... 61-194298

[51] Int. Cl.[4] ..... B27B 17/02

[52] U.S. Cl. ..... 30/381; 123/73 AD

[58] Field of Search ..... 30/381, 382, 383; 123/73 AD

[56] References Cited

U.S. PATENT DOCUMENTS

| | | | |
|---|---|---|---|
| 3,542,095 | 11/1970 | Frederickson et al. | 30/381 |
| 3,680,608 | 8/1972 | Emmerich et al. | 30/381 |
| 4,370,809 | 2/1983 | Takahashi et al. . | |
| 4,446,822 | 5/1984 | Inaga et al. . | |
| 4,548,169 | 10/1985 | Nagashima . | |

*Primary Examiner*—Frank T. Yost
*Assistant Examiner*—Michael D. Folkerts
*Attorney, Agent, or Firm*—Browdy and Neimark

[57] ABSTRACT

A construction for mounting a carburetor on a machine having a driving internal combustion engine such as a portable chain saw, wherein the carburetor is directly fixed to a fuel tank annexed to the engine and the mixture delivery side of the carburetor is connected through a resilient heat-insulating pipe to the suction port of the internal combustion engine.

6 Claims, 1 Drawing Sheet

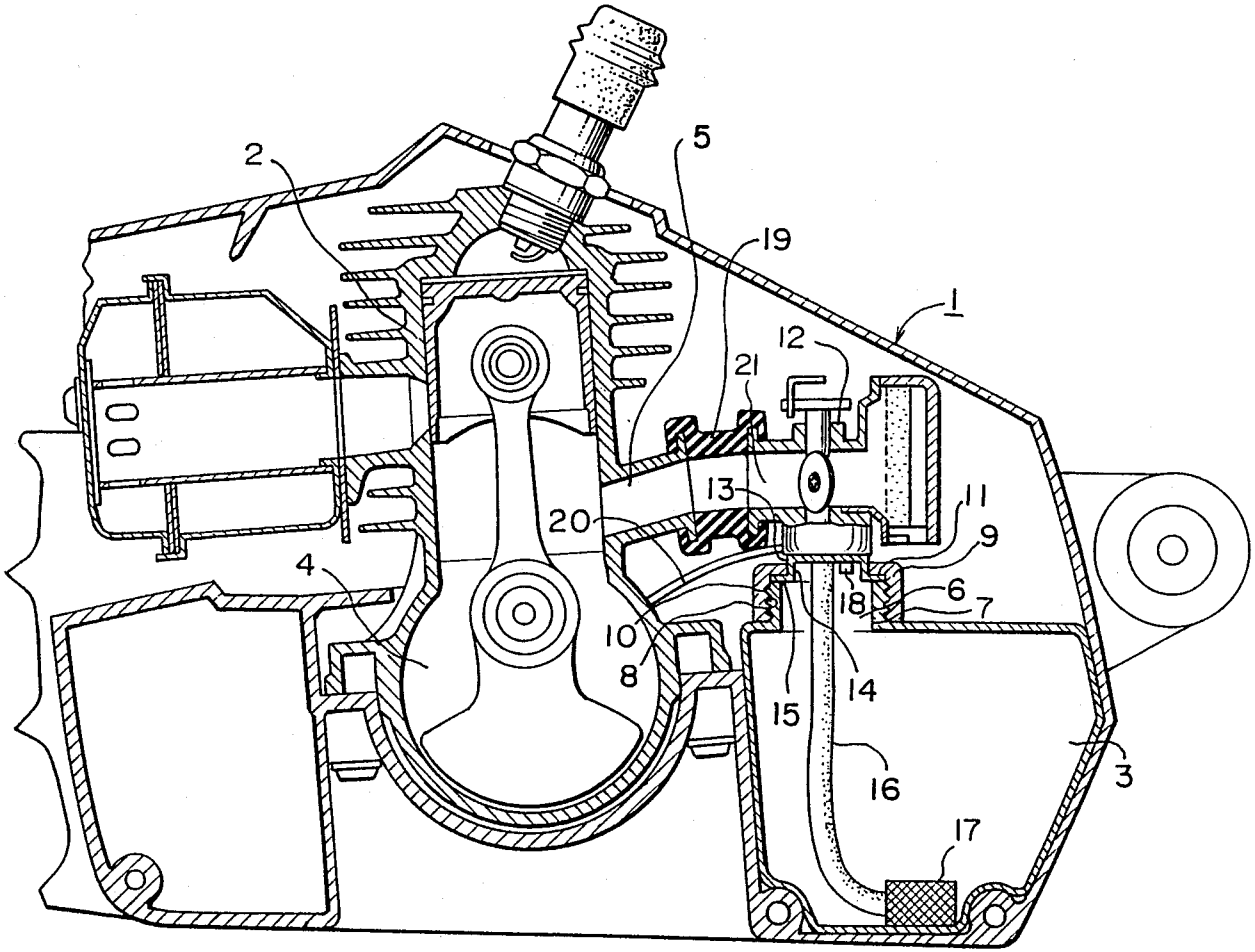
1
2
3
4
5
6
7
8
9
10
11
12
13
14
15
16
17
18
19
20
21

DEVICE FOR MOUNTING CARBURETOR ON INTERNAL COMBUSTION ENGINE

BACKGROUND OF THE INVENTION

1. Field of the Invention

The present invention relates to a device for mounting a carburetor on an internal combustion engine which is used in a portable machines such as a chain saw, grass trimmer and so forth.

2. The Prior Art

In this type of machines, it is a common measure to mount a carburetor in the close proximity of the engine in order to reduce the size and weight of the engine and, hence, of the machine. For instance, it has been proposed to directly mount the carburetor on the cylinder of the engine through an insulation which is adapted for insulating heat from the engine, or to support the carburetor in a floating manner while connecting the same to the engine through a flexible pipe such as a rubber pipe.

The device for mounting the carburetor is essentially required to position the carburetor in the vicinity of the engine while insulating heat. In consequence, the design of the mounting device, as well as the selection of the material, is made difficult. In addition, it is difficult to optimumly arrange the carburetor in relation to the fuel tank. Moreover, different types of engine requires different designs of the carburetor mounting device. In other words, it has been difficult to obtain a standard design of the carburetor mounting device applicable to different types of engines.

SUMMARY OF THE INVENTION

Accordingly, an object of the present invention is to provide a carburetor mounting device which is simple in construction and applicable to a variety types of engines, thereby overcoming the above-described problems of the prior art.

To this end, according to the present invention, there is provided a device for mounting a carburetor comprising: means for fixing the carburetor to a fuel tank; and a resilient heat-insulating pipe through which the mixture delivery side of the carburetor is connected to a mixture suction port of an internal combustion engine.

According to the invention, the carburetor is directly attached to the wall of a fuel tank so that the delivery of the fuel from the fuel tank to the carburetor can be done directly, and the carburetor is sufficiently insulated from heat of the engine.

Thus, the present invention makes it possible to minimize the piping while effectively insulating the carburetor from the heat of the engine. In addition, the carburetor mounting device can be designed comparatively freely without being restricted by the type and configuration of the engine. This in turn makes it possible to obtain a standard design of the carburetor mounting device applicable to a variety of types of engines, and to construct the parts of the fuel feeding system as a block which can be produced beforehand as a sub-assembly, thus improving the efficiency of production of machines of the type mentioned before.

BRIEF DESCRIPTION OF THE DRAWING

The attached sole FIGURE is a sectional view of a chain saw having an embodiment of the carburetor mounting device in accordance with the present invention.

DESCRIPTION OF THE PREFERRED EMBODIMENT

A preferred embodiment of the present invention will be described hereinunder with reference to the attached sole FIGURE which illustrates a chain saw incorporating an embodiment of the present invention.

The chain saw has a frame 1 which carries a 2-stroke cycle internal combustion engine 2 as the power source and a fuel tank 3 storing a fuel which is to be supplied to the engine 2. The engine 2 is provided in a portion of the cylinder side wall thereof with a suction port 5 through which the mixture of fuel and air is introduced into a crank chamber 4.

The fuel tank 3 is made of a suitable material such as a synthetic resin and is provided with an upward projection 7 formed integrally therewith and defining an upward opening 6. The projection 7 is externally threaded as at 8.

A cylindrical clamping member 9 is detachably secured to the upward projection 7. The clamping member 9 is internally threaded as at 10 for engagement with the external thread 8 on the upward projection 7. The clamping member 9 is provided on the upper end thereof with a flange portion 11 which is directed radially inwardly. The inner surface of the flange portion 11 confronts the upper end of the upward projection 7 of the fuel tank 3.

A carburetor 12 is disposed above the upward projection 7 of the fuel tank 3. The carburetor 12 is provided on the underside thereof with a disk-shaped mounting seat 13 which is fixed thereto by, for example, bolts. The outer peripheral portion of the mounting seat 13 is bent downward so as to form a cylindrical skirt portion 14, the lower end of which is bent to extend radially outward so as to form a flange portion 15 which spreads radially outwardly. The cylindrical skirt portion 14 of the mounting seat 13 is extended through an aperture formed in the above-mentioned flange portion 11 which extends radially inward from the clamping member 9, while the radially outward flange portion 15 of the mounting seat 13 is held in contact with the inner surface of the flange portion 11 of the clamping member 9. With this arrangement, as the clamping member 9 is screwed onto the upward projection 7 of the fuel tank 3 through screwing engagement between the internal thread 10 of the clamping member 9 and the external thread 8 of the upward projection 8, the flange portion 15 of the mounting seat is clamped between the upper end of the upward projection 7 of the fuel tanK 3 and the inner surface of the flange portion 11 of the clamping member 9, whereby the carburetor 12 is fixed to the fuel tank 3.

The carburetor 12 has a primer pump (not shown) and a fuel suction tube 16 which extends from the primer pump into the fuel stored in the fuel tank 3 through the opening 6 in the upward projection 7 of the fuel tank 3. The fuel suction tube 16 is provided on the lower end thereof with a fuel strainer 17, through which the fuel is sucked up from the fuel tank into the carburetor 12 via the fuel suction tube 16. The carburetor 12 also is provided with a fuel return port 18 which directly opens into the opening 6 in the upward projection 7 of the fuel tank 3 so as to allow any excess fuel to directly return into the fuel tank 3. It is therefore unnecessary to provide a specific pipe or tube for the purpose of returning the fuel back into the fuel tank 3.

The mixture delivery portion 21 of the carburetor 12 is connected to the suction port 5 of the internal combustion engine through a resilient heat-insulating pipe 19 such as of a rubber. The resilient heat-insulating pipe 19 effectively prevents transmission of heat from the engine 2 to the carburetor 12 while absorbing any dimensional error which may be incurred during assembly.

A reference numeral 20 denotes a pressure pulsation pickup pipe through which the crank chamber 4 of the internal combustion engine is connected to a fuel pump (not shown) of the carburetor 12.

Although in the described embodiment the carburetor is fixed to the fuel tank through the mounting seat, this is only illustrative and various other forms capable of directly attaching the carburetor to the fuel tank may be used equally well. For instance, the present invention includes such a modification that the carburetor is fixed to the fuel tank by means of bolts or by means of a fastening belt.

What is claimed is:

1. A device for mounting a carburetor comprising:

means for fixing said carburetor to a fuel tank comprising:

an upward projection formed integrally with the fuel tank and defining an upwardly directed opening;

a cylindrical clamping member detachably secured to said upward projection and having a flange directed radially inwardly on an upper end thereof, said flange adapted to confront said upward projection when said clamping member is secured thereto;

a disk-shaped mounting seat fixed to an underside of the carburetor, said seat comprising a cylindrical skirt portion formed from an outer peripheral portion of said mounting seat bent downwardly and a flange portion formed from a lower end of said skirt portion which is bent to extend radially outward, wherein said skirt portion is extended through an aperture formed in said flange which extends radially inward from said clamping member and said radially outward flange portion is maintained in contact with an inner surface of said flange, whereby as said clamping member is secured onto said upward projection, said flange portion is clamped between the upper end of said upward projection and the inner surface of said flange for fixing the carburetor to the fuel tank; and a resilient heat-insulating pipe through which the mixture delivery side of said carburetor is connected to a mixture suction port of an internal combustion engine.

2. A device for mounting a carburetor according to claim 1, wherein said fuel tank and said internal combustion engine are mounted on the frame of a chain saw.

3. A device for mounting a carburetor according to claim 1, wherein said upward projection comprises a threaded portion on an outer surface thereof and said clamping member comprises a threaded portion on an inner surface thereof, wherein said clamping member is secured onto said upward projection by the engagement of said threaded portion of said upward projection with said threaded portion of said clamping member.

4. A device for mounting a carburetor according to claim 1, further comprising a fuel suction tube extending from the carburetor into the fuel tank through said opening defined in the upward projection.

5. A device for mounting a carburetor according to claim 4, further comprising a fuel strainer disposed on a lower end of said fuel suction tube in the fuel tank for straining fuel sucked into the carburetor.

6. A device for mounting a carburetor according to claim 1, further comprising a fuel return port formed in the carburetor which directly opens into said opening in said upward projection for allowing any excess fuel to directly return into the fuel tank.

* * * * *